US009517870B2

(12) United States Patent
Lien

(10) Patent No.: US 9,517,870 B2
(45) Date of Patent: Dec. 13, 2016

(54) DUAL LAYER WRAP PACKAGE FOR ASEPTIC PRESENTATION

(71) Applicant: AVENT, INC., Alpharetta, GA (US)

(72) Inventor: Khoa T. Lien, Milton, GA (US)

(73) Assignee: Avent, Inc., Alpharetta, GA (US)

( * ) Notice: Subject to any disclaimer, the term of this patent is extended or adjusted under 35 U.S.C. 154(b) by 659 days.

(21) Appl. No.: 13/955,545

(22) Filed: Jul. 31, 2013

(65) Prior Publication Data

US 2015/0034521 A1 Feb. 5, 2015

(51) Int. Cl.

| | |
|---|---|
| ***B65D 65/02*** | (2006.01) |
| ***B65B 11/00*** | (2006.01) |
| ***B65B 25/14*** | (2006.01) |
| ***B65B 11/48*** | (2006.01) |
| ***B65B 11/58*** | (2006.01) |
| ***B65B 67/08*** | (2006.01) |
| ***B65B 25/20*** | (2006.01) |

(52) U.S. Cl.

CPC ..... *B65D 65/02* (2013.01); *B65B 11/004* (2013.01); *B65B 11/48* (2013.01); *B65B 11/58* (2013.01); *B65B 25/20* (2013.01); *B65B 67/08* (2013.01); *B65B 2220/16* (2013.01)

(58) Field of Classification Search

CPC ..... B65B 11/00; B65B 25/14; B65B 11/02; B65B 67/08

USPC ..... 53/425, 429, 460; 206/438, 440

See application file for complete search history.

(56) References Cited

U.S. PATENT DOCUMENTS

| | | | | |
|---|---|---|---|---|
| 3,338,992 | A | 8/1967 | Kinney | |
| 3,341,394 | A | 9/1967 | Kinney | |
| 3,502,763 | A | 3/1970 | Hartmann | |
| 3,542,615 | A | 11/1970 | Dobo et al. | |
| 3,692,618 | A | 9/1972 | Dorschner et al. | |
| 3,802,817 | A | 4/1974 | Matsuki et al. | |
| 3,849,241 | A | 11/1974 | Butin et al. | |
| 4,340,563 | A | 7/1982 | Appel et al. | |
| 4,705,171 | A * | 11/1987 | Eldridge | A61F 15/001 128/846 |
| 5,057,368 | A | 10/1991 | Largman et al. | |
| 5,069,970 | A | 12/1991 | Largman et al. | |
| 5,277,976 | A | 1/1994 | Hogle et al. | |
| 5,466,410 | A | 11/1995 | Hills | |
| 5,635,134 | A | 6/1997 | Bourne et al. | |
| 6,406,764 | B2 | 6/2002 | Bayer | |
| 6,578,348 | B1 * | 6/2003 | Banks | B65D 27/22 53/425 |
| 7,560,082 | B2 | 7/2009 | Stecklein et al. | |
| 7,922,983 | B2 | 4/2011 | Prokash et al. | |

(Continued)

FOREIGN PATENT DOCUMENTS

| | | |
|---|---|---|
| CH | 437115 | 5/1967 |
| GB | 2 252 910 A | 8/1992 |

OTHER PUBLICATIONS

Search Report and Written Opinion for PCT/IB2014/063479 dated Nov. 3, 2014, 9 pages.

*Primary Examiner* — Michelle Lopez

(74) *Attorney, Agent, or Firm* — Dority & Manning, P.A.

(57) ABSTRACT

The present disclosure describes a procedure for wrapping an item to be sterilized with two fabric sheets in such a way as to allow a rapid unwrapping of the item for use. This procedure saves time in unwrapping and reduces the risk of loss of sterility of the item and stress on medical personnel.

9 Claims, 6 Drawing Sheets

(56) References Cited

U.S. PATENT DOCUMENTS

| | | | | |
|---|---|---|---|---|
| 2007/0095699 | A1* | 5/2007 | Frieze | A61L 2/07 206/438 |
| 2015/0033673 | A1* | 2/2015 | Lien | A61B 19/045 53/461 |

* cited by examiner

DUAL LAYER WRAP PACKAGE FOR ASEPTIC PRESENTATION

BACKGROUND

The present disclosure relates to a packaging system for protection and aseptic presentation of sterilized items. One use of the invention is for protecting and aseptically presenting folded sterile protective garments such as surgical gowns.

Protective garments, such as coveralls and gowns, designed to provide barrier protection to a wearer are well known in the art. Such protective garments are used in situations where isolation of a wearer from a particular environment is desirable, or it is desirable to inhibit or retard the passage of hazardous liquids and biological contaminates through the garment to the wearer.

In the medical and health-care industry, particularly with surgical procedures, a primary concern is isolation of the medical practitioner from patient fluids such as blood, saliva, perspiration, etc. In addition, surgical gowns must be sterile for use to protect the patient from infection.

Surgical gowns are normally packaged by the manufacturer within a protective sheet material within which the gown may be sterilized. Appropriate protective sheet material includes those as shown, for example, in U.S. Pat. No. 5,635,134 to Bourne, et al. which discloses a multi-ply sterilization wrap which is formed by joining one or more sheets of sterilization wrap (e.g., two separate sheets or one sheet folded over) together to form two similarly sized, superposed panels that allow convenient dual wrapping of an article. As another example, U.S. patent publication 2001/0036519 by Robert T. Bayer discloses a two ply sterilization wrap that is formed of a single sheet of sterilization wrap material which is folded to form two similarly sized, superposed panels that are bonded to each other. As yet another example, U.S. patent publication No. 2005/0163654 by Stecklein, et al. discloses a sterilization wrap material that has a first main panel and a second panel that is smaller than the main panel. The second panel is superposed and bonded to the central portion of the main panel such that it is contained entirely within the main panel to reinforce the main panel and/or provide additional absorbency. Sterilization wraps may also have a single ply only and these are suitable for use with the invention. Sterilization wraps are commonly made from non-woven materials made by the spunbonding and meltblowing processes.

Once sterilized, the gown must be removed from the protective sheet for use. This removal procedure can be quite complicated, involving numerous steps that must be performed in a fashion that maintains the sterility of the gown. FIG. 1 shows an eleven step procedure for the removal of a gown from its packaging and will be discussed in greater detail below. This prior art procedure takes quite some time and must be performed properly to maintain the sterility of the gown. If the sterility of the gown is lost, the gown must be discarded and another opened, obviously raising costs.

A procedure for wrapping a surgical gown so that it may be unwrapped and removed from its packaging more quickly, i.e. with fewer steps, and with less risk of loss of sterility would help reduce costs and reduce stress for medical personnel.

SUMMARY

The present disclosure describes a packaging system and a method or procedure for use of the system for protecting and presenting a sterilized item, e.g. a surgical gown. This procedure reduces the number of steps required for unwrapping. This procedure saves time in unwrapping and reduces the risk of loss of sterility of the gown and stress on medical personnel.

The procedure of packaging includes at least the steps of:

a) laying out two sheets, aligned, with an inner sheet on top of an outer sheet, unfolded and flat, the sheets having north, south, east and west corners with the lower surface of the outer sheet on a flat surface, b) placing the item on the inner sheet in approximately the center, c) folding the north corner of the inner sheet over the item, d) folding the south corner of the inner sheet over the item, e) gathering the southernmost portions of the inner sheet on east and west sides that are near two opposing sides of the item and folding them towards the north so that they fold at an angle to either side of the item to form a "wing", and folding the gathered fabric "wings" under the package so that they are under the item, f) folding the south corner of the outer sheet over the item, and then folding the south corners of both sheets back towards the south, g) folding the north corner of the outer sheet over the item, h) gathering the north corner with the south corners to create a six ply pleat that spans completely across the upper surface and sides of the item and laying the pleat down onto the item in the south direction, i) gathering the southernmost portions of the outer sheet on the east and west sides that are near two opposing sides of the item and folding them towards the north so that they fold at an angle to either side of the item to form a "wing", and folding the gathered fabric "wings" under the package so that they are under the item, j) securing the east and west sides on the back of the package.

Other objects, advantages and applications of the present disclosure will be made clear by the following detailed description of a preferred embodiment of the disclosure and the accompanying drawings wherein reference numerals refer to like or equivalent structures.

DETAILED DESCRIPTION

Figure 1A:
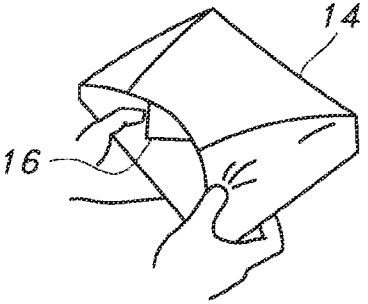
FIG. 1a (PRIOR ART)
FIG. 1 is a series of drawings (a through k) of the prior art steps of unwrapping a an item, as exemplified by a folded gown.
Figure 1B:
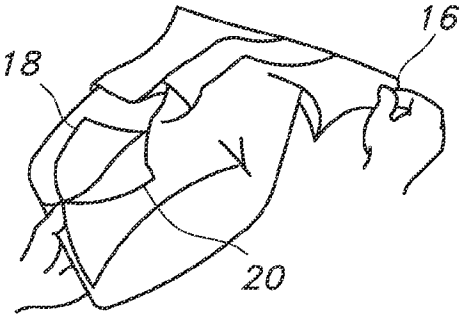
FIG. 1b (PRIOR ART)
Figure 1C:
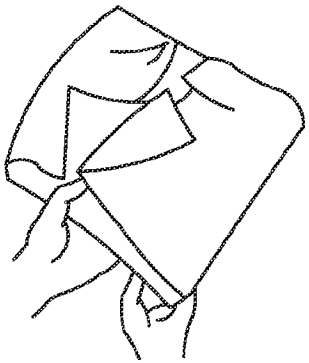
FIG. 1c (PRIOR ART)
Figure 1D:
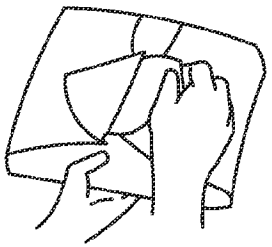
FIG. 1d (PRIOR ART)
Figure 1E:
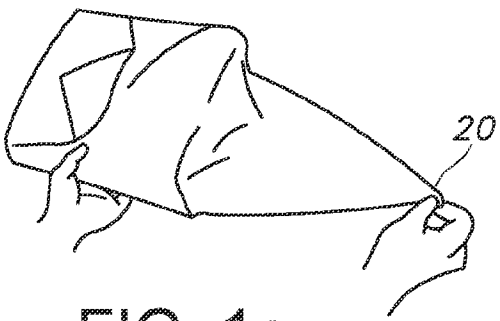
FIG. 1e (PRIOR ART)
Figure 1F:
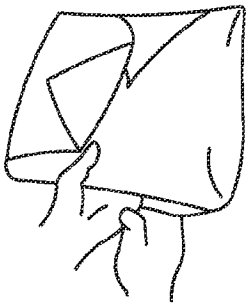
FIG. 1f (PRIOR ART)
Figure 1G:
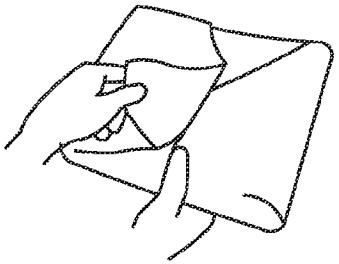
FIG. 1g (PRIOR ART)
Figure 1H:
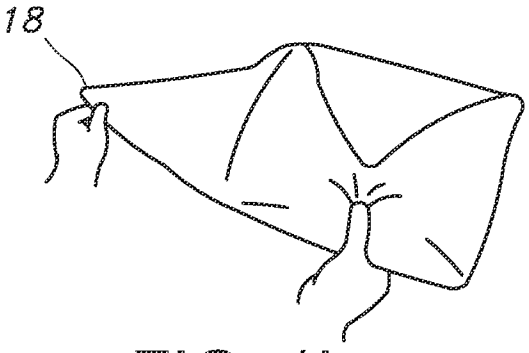
FIG. 1h (PRIOR ART)
Figure 1J:
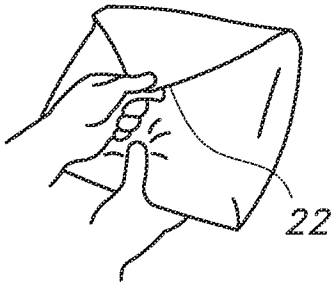
FIG. 1j (PRIOR ART)
Figure 1I:
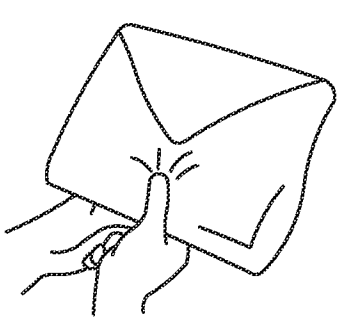
FIG. 1i (PRIOR ART)
Figure 1K:
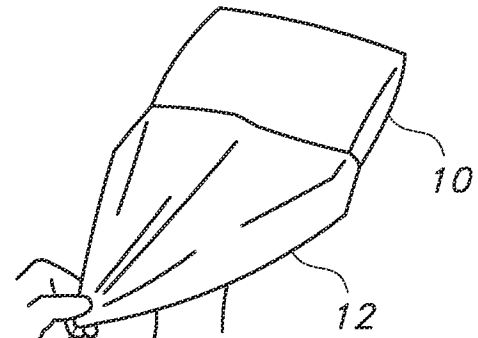
FIG. 1k (PRIOR ART)

Reference will now be made to the drawings in which the various elements of the present disclosure will be given numeral designations and in which the disclosure will be discussed so as to enable one skilled in the art to make and use the disclosure. It is to be understood that the following description is only exemplary of the principles of the present disclosure, and should not be viewed as narrowing the pending claims. Those skilled in the art will appreciate that aspects of the various embodiments discussed may be interchanged and modified without departing from the scope and spirit of the disclosure.

FIG. 1 is a series of drawings (a through k) of the prior art steps of unwrapping a gown. In FIG. 1*a* the wrapped gown 14 is held in the hands with an exposed corner 16 pointing at the user. The exposed corner is peeled upwardly away from the user (FIG. 1*b*) to expose two opposite corners 18, 20 folded facing away from each other. The part peeled away from the user is folded under the package (FIG. 1*c*). The right hand corner 20 exposed in FIG. 1*b* is pulled to the right (FIGS. 1*d* and *e*) and folded under the package (FIG. 1*f*). The left hand corner 18 exposed in FIG. 1*b* is pulled to the left (FIG. 1*g* and *h*) and folded under the package (FIG. 1*i*). The remaining corner 22 is pulled towards the user (FIG. 1*j*) to reveal the gown 10 (FIG. 1*k*) that may then be deposited on a sterile surface for use, completely free of the wrap 12.

The disclosed procedure of wrapping a gown produces a package that may be opened with far fewer steps than that of the prior art. It should be noted that the procedure below is comprehensive and that some steps may be eliminated (e.g. the final presentation step) as will be obvious to those skilled in the art. For ease of understanding the two sheets in FIG. 2 are different shades or colors, though an actual sterilization wrap may have different or the same colors on each sheet.

Figure 2A:
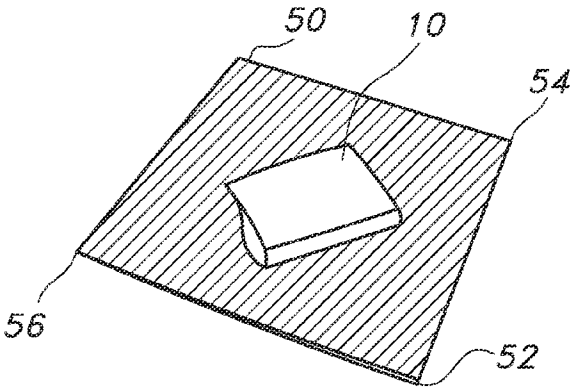
FIG. 2 shows the unique folding technique disclosed herein. There is a series of drawings (a through x) of the steps for wrapping an item, as exemplified by a folded gown.
Figure 2B:
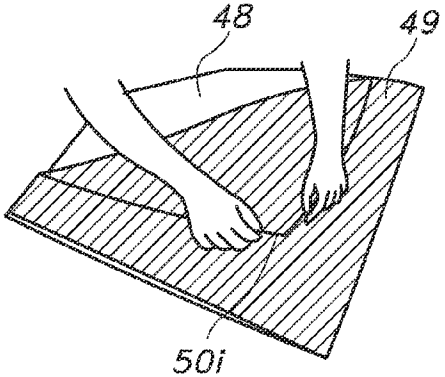
Figure 2C:
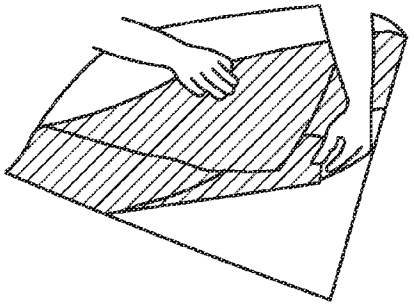
Figure 2D:
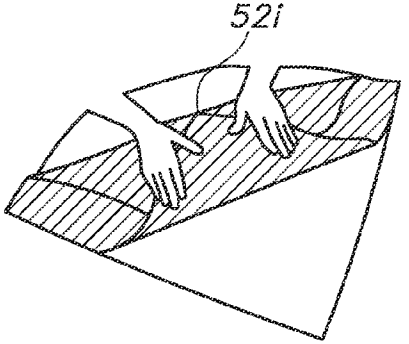
Figure 2E:
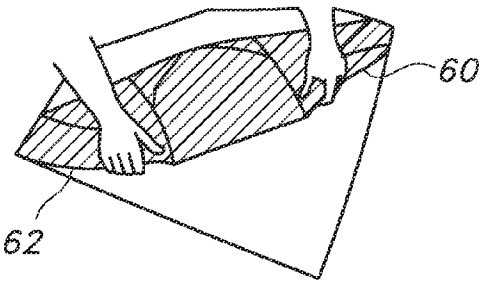
Figure 2F:
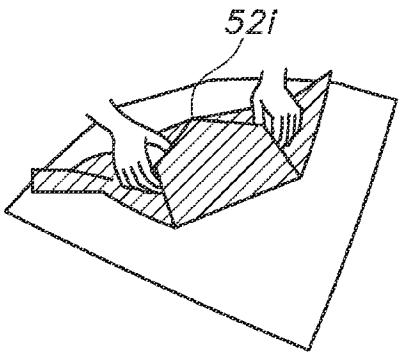
Figure 2I:
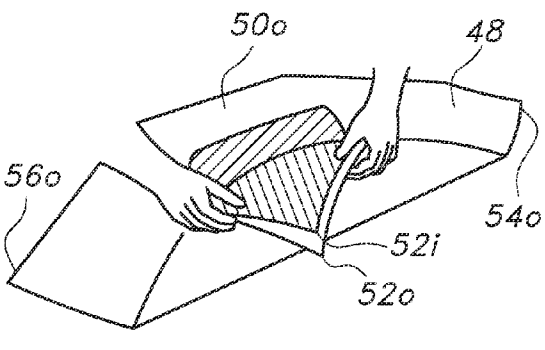
Figure 2H:
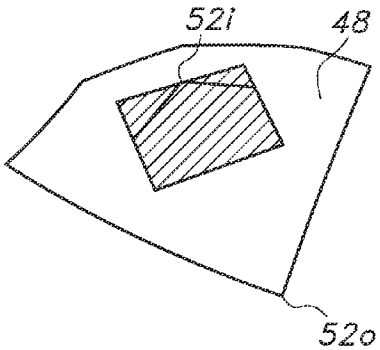
Figure 2G:
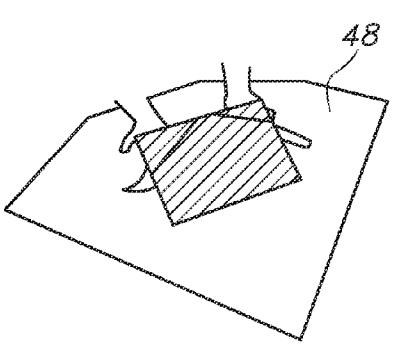
Figure 2L:
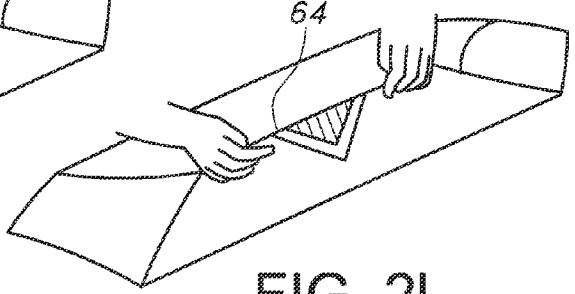
Figure 2K:
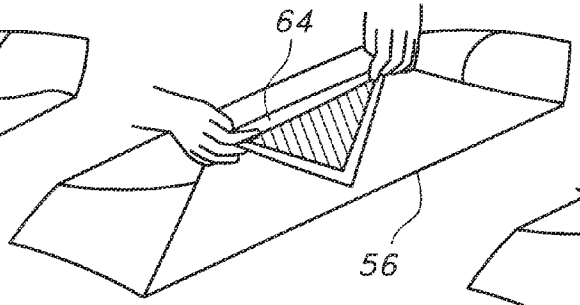
Figure 2J:
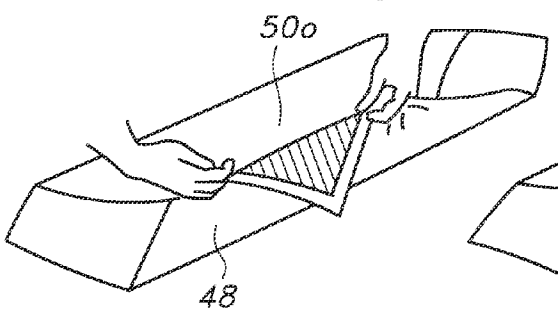
Figure 2N:
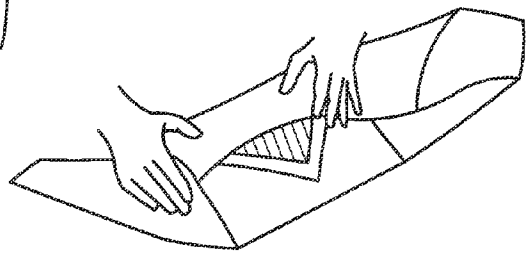
Figure 2M:
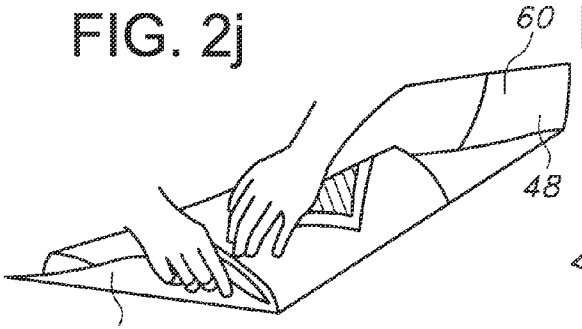
Figure 2R:
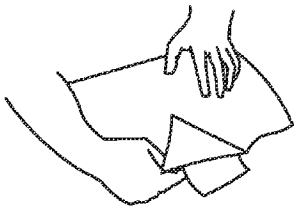
Figure 2V:
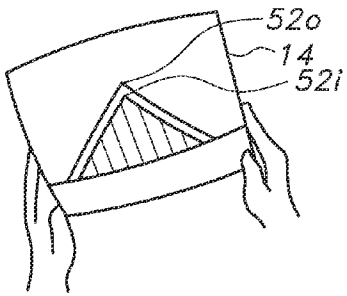
Figure 2Q:
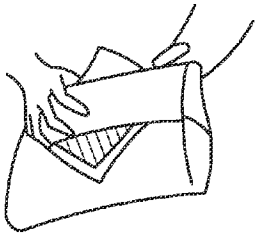
Figure 2U:
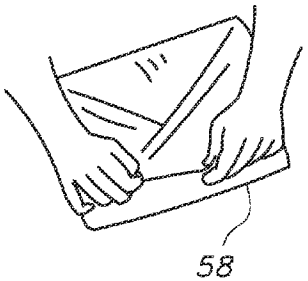
Figure 2P:
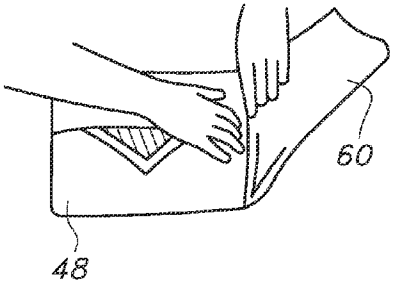
Figure 2T:
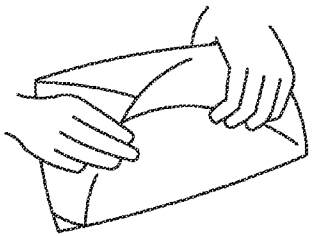
Figure 2X:
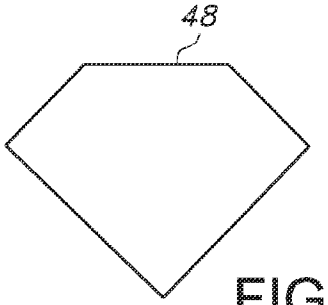
Figure 2O:
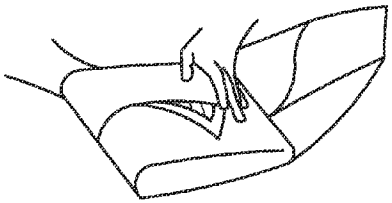
Figure 2S:
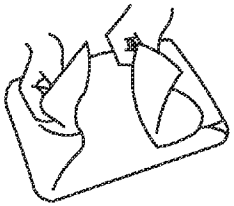
Figure 2W:
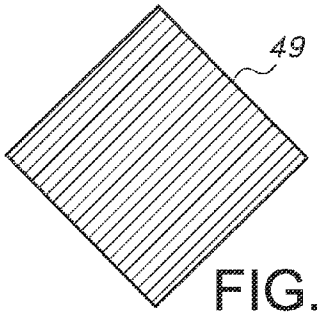
Figure 3A:
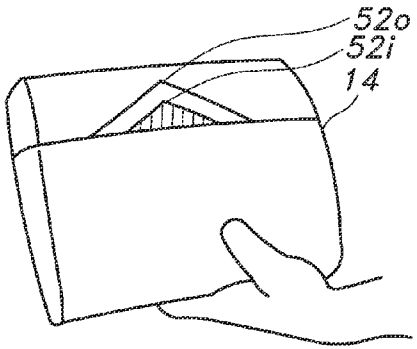
FIG. 3 is a series of drawings (a through f) of the steps of unwrapping an item that has been wrapped according to the disclosed procedure.
Figure 3B:
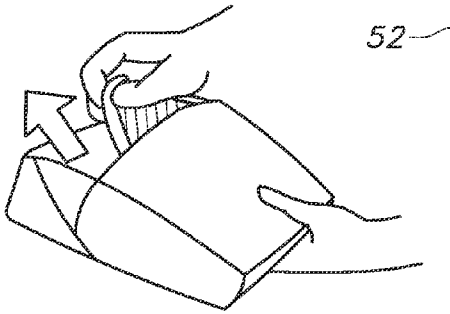
Figure 3C:
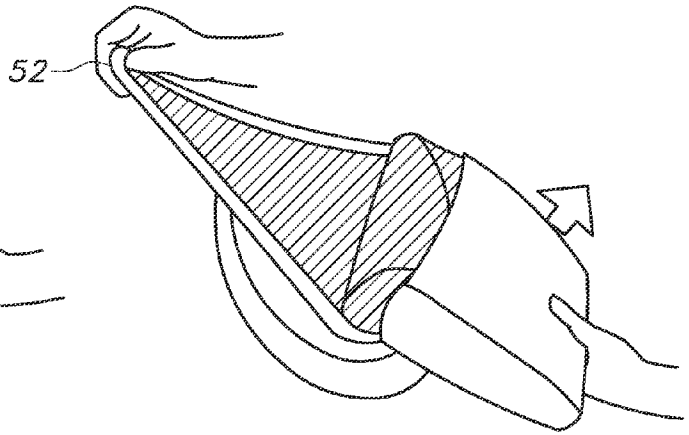
Figure 3D:
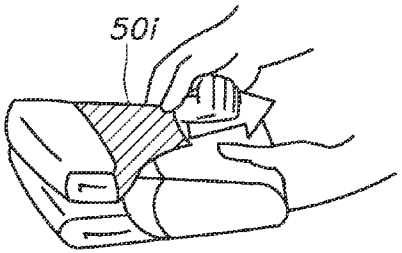
Figure 3E:
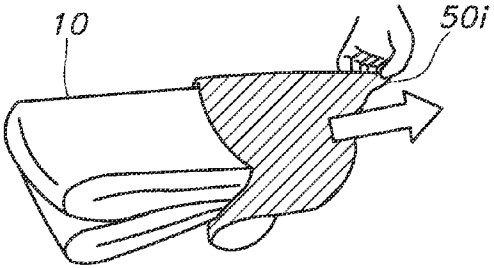
Figure 3F:
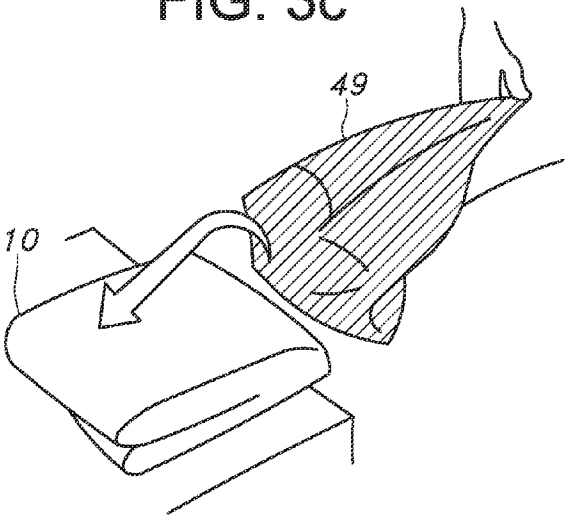

The two sheets 49, 48 are shown individually in FIGS. 2*w* and 2*x* respectively. The outer sheet 48 is generally of the same dimensions as the inner sheet 49 but desirably has one corner removed or folded to obtain the appearance of a missing corner as shown. The missing corner portion of the sheet 48 is sufficient to leave the inner and outer south corners of the sheets exposed when the north corner 50*o* of the outer sheet 48 is folded over the item (FIG. 2*j*) and yet also of sufficient size to allow the north corner 50*o* to participate in the formation of the pleat 62 (FIG. 2*k*). In one embodiment, the outer sheet 48 is approximately 24 by 24 inches (61 by 61 cm) square and its cut out or missing (folded over) corner is 12 by 12 by 17 inches (30.5 by 30.5 by 43 cm) (FIG. 2*x*). Other successful size relationships are within the normal ability of those skilled in the art without undue experimentation.

In the Figures, the sheets have north, south, east and west corners denoted as 50, 52, 54, 56 respectively. The inner sheet 49 corners are denoted by an "i" after the notation number and the outer sheet corners by an "o". Since the outer sheet does not have a functional north corner, the notation "500" refers to the northernmost part of the outer sheet 48.

The steps of folding include:

1) laying out the two sheets 48, 49, aligned, with the inner sheet 49 on top of the outer sheet 48, unfolded and flat, the sheets having north, south, east and west corners (50, 52, 54, 56) as indicated in FIG. 2*a*, with the lower surface 56 of the outer sheet 48 on a flat surface,
2) placing the item 10 on the inner sheet 49 (FIG. 2*a*) in approximately the center,
3) folding the north corner 50*i* of the inner sheet 49 over the item (FIG. 2*b*). Note that the person folding the sheets is located near the north corner of the sheets,
4) folding the south corner 52*i* of the inner sheet 49 over the item (FIG. 2*c* and *d*),
5) gathering the southernmost portions of the inner sheet 49 on the east and west sides 60, 62 that are near two opposing sides of the item (FIG. 2*e*) and folding them towards the north so that they fold at an angle to either side of the item (FIG. 2*f*) to form a "wing", (note, the wings should not fold over the item) and folding the gathered fabric "wings" under the package so that they are desirably fully under the item (FIG. 2*g*, 2*h*),
6) folding the south corner 52*o* of the outer sheet 48 over the item, and then folding the south corners 52*i*, 52*o* of both sheets back towards the south (FIG. 2*i*) to at least partially cover the top of the item,
7) folding the north corner 500 of the outer sheet 48 over the item (FIG. 2*j*),
8) gathering (the edge of) the north corner 500 of the outer sheet 48 with the south corners 52*o*, 52*i* to create a six ply pleat 64 that spans completely across the upper surface and sides of the item (FIG. 2*k*) and laying the pleat down onto the item in the south direction (FIG. 2*l*),
9) gathering the southernmost portions of the outer sheet 48 on the east and west sides 60, 62 that are near two opposing sides of the item (FIG. 2*m*) and folding them towards the north so that they fold at an angle to either side of the item (FIG. 2*n*) to form a "wing", (note, the wings should not fold over the item) and folding the gathered fabric "wings" under the package so that they are desirably fully under the item (FIG. 2*o*, 2*p*, 2*q*),
10) turning the partially wrapped item over (FIG. 2*r*) to expose to back of the package (the surface opposite the folded north and south corners),
11) securing the east and west sides 60, 62 on the back of the package, for example, by overlapping the east and west corners 560, 54*o* of the outer sheet 48 and associated fabric on the back of the package with each other (FIG. 2*s*) and folding the east and west sides together, one under the other (i.e., tucking one into the other), to create a neat fold 58 (Figures (FIGS. 2*t*, 2*u*),
12) turning the package over or right side up (FIG. 2*v*) to expose the folded north and south corners. This provides a package 14, the item 10 securely located inside and isolated from the external environment by the sheet and the folds of the sheet. The package is easily opened by pulling the corners 52 (FIG. 2*v*), making the contents immediately available for use.

FIG. 3 is a series of drawings (a through f) of the steps of unwrapping a gown that has been wrapped according to this disclosure. In FIG. 3*a* the wrapped gown 14 is held in the hands with two exposed corners 52*o*, 52*i* pointing away from the user. The exposed corners 52*o*, 52*i* are peeled away from the user (FIG. 3*b*) and folded under the package (FIG. 3*c*). This action exposes the southern corner 50*i* of the inner sheet 49 which is then pulled towards the user (FIG. 3*d*) to expose the item 10 (FIG. 3*e*) so that it may then be deposited on a sterile surface for use, completely free of the wrap (FIG. 3*f*). This method of wrapping provides an aseptic package that may be easily unwrapped for use.

By "aseptic opening" is meant that unfolded surfaces of the package do not pass over the contents of the package during the process of opening. This ensures that the inner sterilized surfaces of the packaging always fold away from the contents.

Single layer packages generally require the provision of a sterilizable outer packaging material (e.g. Teflon® or Tyvek® bag) to maintain sterility after manufacturing and wrapping. The pleat and the folding of the sets of "wings" under the package in the disclosed procedure create a tortuous path for microbes to enter the sterilized package. Because of this, the disclosed two layer package does not require (i.e., is generally free of) a sterilizable outer package and may merely be shrink wrapped in plastic for shipping and still maintain its sterility.

The sheets used in the packaging procedure disclosed herein is shown in the drawings as approximately square for ease of illustration. This is not meant to be limiting since in actual practice the sheets may be square, rectangular, diamond shaped or of another shape. In addition, though the terminology herein has referred to "gowns" for ease of discussion, the item wrapped using the disclosed procedure may be, for example, a kit containing medical instruments, a medical device, or virtually anything that may be wrapped and sterilized, and is not meant to limit the disclosure to "gowns". Sterilization commonly occurs by a sterilant penetrating through the package.

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting sheet. Spunbond fibers are generally continuous and have average diameters (from a sample of at least 10) larger than 7 microns, more particularly, between about 10 and 20 microns. The fibers may also have shapes such as those described in U.S. Pat. No. 5,277,976 to Hogle et al., U.S. Pat. No. 5,466,410 to Hills and U.S. Pat. Nos. 5,069,970 and 5,057,368 to Largman et al., which describe fibers with unconventional shapes.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting sheet to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting sheet.

As used herein and in the claims, the term "comprising" is inclusive or open-ended and does not exclude additional unrecited elements, compositional components, or procedure steps.

While various patents have been incorporated herein by reference, to the extent there is any inconsistency between incorporated material and that of the written specification, the written specification shall control. In addition, while the disclosure has been described in detail with respect to specific embodiments thereof, it will be apparent to those skilled in the art that various alterations, modifications and other changes may be made to the disclosure without departing from the spirit and scope of the present disclosure. It is therefore intended that the claims cover all such modifications, alterations and other changes encompassed by the appended claims.

What is claimed is:

1. A procedure of packaging an item comprising the steps of:

a) laying out two sheets, aligned, with an inner sheet on top of an outer sheet, unfolded and flat, the sheets having north, south, east and west corners with the lower surface of the outer sheet on a flat surface, b) placing the item on the inner sheet in approximately the center, c) folding the north corner of the inner sheet over the item, d) folding the south corner of the inner sheet over the item, e) gathering the southernmost portions of the inner sheet on east and west sides and folding them towards the north so that they form a "wing", and folding the "wings" under the item so that they are under the item to form a package, f) folding the south corner of the outer sheet over the item, and then folding the south corners of both sheets back towards the south, g) folding the north corner of the outer sheet over the item, h) gathering the north corner of the outer sheet with the south corners to create a six ply pleat that spans completely across the upper surface and sides of the item and laying the pleat down onto the item in the south direction, i) gathering the southernmost portions of the outer sheet on the east and west sides and folding them towards the north so that they form a "wing", and folding the "wings" under the unfolded portion of the lower sheet, and j) securing the east and west sides to the outer surface of the package that is generally opposite the folded north and south corners.

2. The procedure of claim 1 further comprising the step of turning the package over prior to securing the east and west sides on the back of the package.

3. The procedure of claim 2 wherein securing the east and west sides on the back of the package is accomplished by folding the east and west sides together, one under the other, to create a neat fold.

4. The procedure of claim 1 wherein the item is selected from the group consisting of gowns, medical kits and medical devices.

5. The procedure of claim 1 wherein the item is sterilized by a sterilant penetrating through the package.

6. The procedure of claim 1, wherein the item and an encasing sheet are formed into the package.

7. The procedure of claim 6 wherein the item remains sterile until the package is opened.

8. The procedure of claim 6 wherein the item is selected from the group consisting of gowns, drapes, medical kits and medical devices.

9. The procedure of claim 6, further comprising aseptically presenting the item contained within the package.

* * * * *